United States Patent [19]

Hofmann et al.

[11] Patent Number: 4,618,097

[45] Date of Patent: Oct. 21, 1986

[54] FUEL INJECTION NOZZLE FOR INTERNAL COMBUSTION ENGINES

[75] Inventors: Karl Hofmann, Remseck; Walter Mladek, Stuttgart; Bernhard Kaczynski, Waiblingen, all of Fed. Rep. of Germany

[73] Assignee: Robert Bosch GmbH, Stuttgart, Fed. Rep. of Germany

[21] Appl. No.: 200,655

[22] Filed: Oct. 27, 1980

[30] Foreign Application Priority Data

Oct. 30, 1979 [DE] Fed. Rep. of Germany ..... 2943745

[51] Int. Cl.[4] ..... F02M 61/16

[52] U.S. Cl. ..... 239/124; 239/533.2; 239/600

[58] Field of Search ..... 239/533.2–533.12, 239/600, 124

[56] References Cited

U.S. PATENT DOCUMENTS

| | | | |
|---|---|---|---|
| 1,977,782 | 10/1934 | Thomas | 239/600 X |
| 3,934,903 | 1/1976 | Hofmann et al. | 239/533.3 X |
| 4,284,049 | 8/1981 | Chmela | 239/533.8 X |

*Primary Examiner*—Andres Kashnikow

*Attorney, Agent, or Firm*—Edwin E. Greigg

[57] ABSTRACT

A fuel injection nozzle is proposed in which the wrench hexagon of the nozzle holder, in order to reduce the structural length, is arranged to surround the spring chamber and the leakage oil connection is placed in this area of material reinforcement.

3 Claims, 1 Drawing Figure

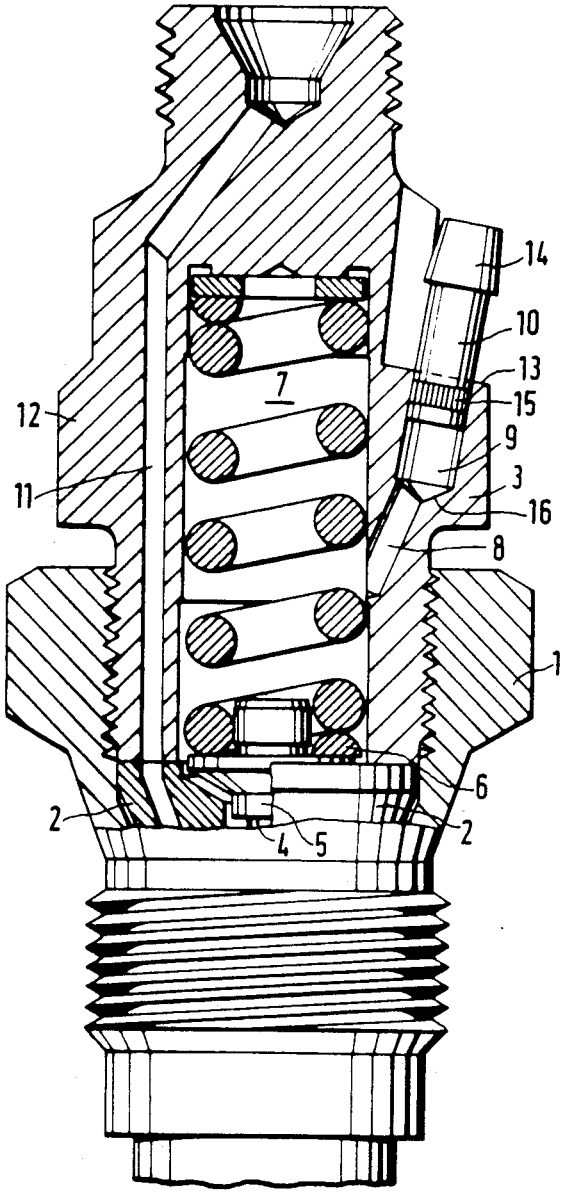
14
10
13
15
9
3
16
8
1
6
2
2
4
5
7
12
11

FUEL INJECTION NOZZLE FOR INTERNAL COMBUSTION ENGINES

BACKGROUND OF THE INVENTION

The invention relates to a fuel injection nozzle for internal combustion engines having a nozzle holder which includes an axially-extending pressure connection, a spring chamber, and a leakage oil connection grommet which is disposed in a bore on a radial wall reinforcement of the nozzle holder embodied by a wrench hexagon and which communicates with the spring chamber. Known fuel injection nozzles of this kind have a relatively great structural length, because the closing spring of the valve needle, which in these nozzles opens inward, requires a certain minimum length, and accomodating the pressure line connection and the leakage line connection requires a substantial amount of space. However, engine designers increasingly demand that fuel injection nozzles be as short as possible, frequently specifying a maximum acceptable length. The patent literature is full of examples of the efforts which have been made to solve this problem. This work has been made substantially more difficult by a second requirement made by engine designers, that the nozzle dimension be limited in width as well. Specifically, this limitation is such that the injection nozzle must be capable of being mounted by using a socket wrench, and the position of the leakage oil hose grommet must not be a hindrance to the socket wrench. In a known fuel injection nozzle, therefore, the leakage oil hose grommet was disposed obliquely relative to the connection nozzle for the injection line, in fact next to the connection nozzle in such a way that the increased amount of material on the nozzle holder hexagon was utilized for securing the grommet. The leakage oil hose grommet in such a nozzle is caulked in the bore of the nozzle holder which receives it in order to attain the necessary stability and sealing quality, because there is no space available for an additional sealing ring. Because of all these requirements, the task of designing a shorter fuel injection nozzle has faced virtually insurmountable difficulties.

OBJECT AND SUMMARY OF THE INVENTION

A fuel injection nozzle, of the type described above, has its wrench hexagon and leakage oil bores disposed in a jacket region of the nozzle holder which radially surrounds the spring chamber.

The fuel injection nozzle according to the invention, by overcoming the disadvantage of an unsuitable jacket region, attains the advantage of a substantial shortening of the injection nozzle. A substantial further advantage is that the leakage oil hose grommet is disposed at a certain distance from the pressure connection threads, so that the pressure connection can be loosened without having to remove the leakage oil hoses from their grommets beforehand. As is well known, each time a fuel-carrying line is loosened, there is the disadvantage of a partial escape of fuel, which even aside from the danger of fire has the disadvantage of causing soiling on each occurrence.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing is a simplified cross-sectional view of one exemplary embodiment of the invention.

DESCRIPTION OF THE PREFERRED EMBODIMENT

In the fuel injection nozzle shown, a nozzle body, not visible, is held clamped to a nozzle holder 3 via a clamping nut 1, with an interposed intermediate plate 2. The nozzle holder receives a nozzle needle 4, which is under the influence of a closing spring 6 via a spring plate 5. The closing spring 6 is disposed in a spring chamber 7, which is relieved of pressure toward a leakage oil hose grommet 10 via a bore 8 and a bore 9 of larger diameter. The pressure chamber, not visible, which is disposed between the valve needle 4 and the nozzle body is supplied with fuel via a pressure channel 11 from the connection side of the fuel injection nozzle.

The hexagon 12 of the nozzle holder 3, which can be engaged by the socket wrenches or single-head wrenches to be used, is disposed in the jacket region of the nozzle holder, surrounding the spring chamber 7. As a result of this disposition, there is a certain increase in material at this location, into which a face 13 has been cut and from which the leakage oil hose grommet 10 branches off, perpendicular thereto. The hose grommet 10, except for the fastening cone 14, has a diameter which is only insignificantly larger than that of the bore 9 receiving a portion of the grommet 10. On the jacket face of the grommet 10, a knurled area 15 is provided, so that after the insertion of the hose grommet 10 into the bore 9, the bore wall material in part flows into this knurled area 15 and accordingly holds securely in such a manner as to resist twisting and removal. The diameter of the grommet 10, and naturally that of the bore 9 as well, is selected to be smaller than that in the known nozzles, in order that a minimum wall thickness of the nozzle holder 3 will be sufficient. For caulking, an increased material thickness is necessary, because a substantial additional amount of deformation occurs as a result of the caulking. In any case, the force required to remove a hose conventionally amount to 20 kilograms. The tapering of the grommet 10 is also possible because, first, a knurled area 15 is used for fastening purposes, and, second, the diameter is kept virtually constant.

The leakage oil connection between the bore 9 and the spring chamber 7 is provided by the bore 8 of smaller diameter which branches off from the bottom of the bore 9. The bore 8 is thus more sharply inclined toward the spring chamber 7 than is the bore 9; in fact, it is inclined to the extent permitted by the drilling of the bore 8 without damaging the jacket face of the bore 9 at its entrance. In each case, the bore 8 branches toward the spring chamber 7 as eccentrically as possible from the base 16 of the bore 9. The bore 9 itself and thus the hose grommet 10 are disposed obliquely relative to the axis of the injection nozzle, the degree of obliquity being selected such that a socket wrench can be pushed onto the hexagon 12 without the hose grommet 10 being in the way.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection nozzle for internal combustion engines having a nozzle holder provided with a pressure connection extending axially thereof, said nozzle holder further including a spring chamber and at least one leakage oil connection grommet communicating via first and second oil leakage bores with said spring chamber, said grommet disposed in said first oil leakage bore on a radial wall reinforcement of the nozzle holder embodied specifically by a wrench hexagon, the improvement wherein:

said nozzle holder further includes a jacket region which radially surrounds said spring chamber; and said wrench hexagon and said jacket region includes said first and second leakage oil bores which are disposed in sequence and discharge directly into said spring chamber, said second oil leakage bore being of a smaller diameter and inclined more sharply than said first oil leakage bore toward said spring chamber, said second oil leakage bore arranged to branch off eccentrically from a base of said first bore, and said first oil leakage bore has an inlet area arranged to receive said grommet and further that said grommet has a peripheral portion forming a knurled area and adapted to be grasped by said inlet area on insertion of said grommet into said inlet area.

2. A fuel injection nozzle as defined by claim 1, characterized in that said grommet has a major cylindrical portion and a minor conical portion, said major cylindrical portion including said knurled area.

3. In a fuel injection nozzle for internal combustion engines having a nozzle holder provided with a pressure connection extending axially thereof, said nozzle holder further including a spring chamber and at least one leakage oil connection grommet communicating via first and second leakage oil bores with said spring chamber, said grommet disposed in said first leakage oil bore on a radial wall reinforcement of the nozzle holder embodied specifically by a wrench hexagon, the improvement wherein:

said nozzle holder further includes a jacket region which radially surrounds said spring chamber; and said wrench hexagon and said first and second leakage oil bores are disposed in said jacket region, and said grommet further includes a knurled enlarged area for fastening said grommet within said first bore.

* * * * *